US005474867A

United States Patent [19]

Ritt et al.

[11] Patent Number: 5,474,867

[45] Date of Patent: Dec. 12, 1995

[54] METHOD OF MANUFACTURING A LUMINESCENT SCREEN FOR A CRT UNDER AMBIENT CONTROLS

[75] Inventors: Peter M. Ritt, E. Petersburg; Charles M. Wetzel, Lititz; Harry R. Stork, Adamstown; John J. Moscony, Lancaster, all of Pa.

[73] Assignee: Thomson Consumer Electronics, Inc., Indianapolis, Ind.

[21] Appl. No.: 305,952

[22] Filed: Sep. 16, 1994

[51] Int. Cl.[6] ..... G03C 5/00

[52] U.S. Cl. ..... 430/23; 430/25; 430/26; 430/28

[58] Field of Search ..... 430/23, 25, 26, 430/28

[56] References Cited

U.S. PATENT DOCUMENTS

| | | | |
|---|---|---|---|
| 3,558,310 | 1/1971 | Mayaud | 96/36.1 |
| 4,921,767 | 5/1990 | Datta et al. | 430/23 |
| 5,028,501 | 7/1991 | Ritt et al. | 430/23 |
| 5,083,959 | 1/1992 | Datta et al. | 445/52 |
| 5,135,826 | 8/1992 | Ritt et al. | 430/28 |
| 5,229,234 | 7/1993 | Riddle et al. | 430/28 |
| 5,240,798 | 8/1993 | Ehemann, Jr. | 430/23 |
| 5,370,952 | 12/1994 | Datta et al. | 430/23 |

*Primary Examiner*—S. Rosasco

*Attorney, Agent, or Firm*—Joseph S. Tripoli; Dennis H. Irlbeck; Vincent J. Coughlin, Jr.

[57] ABSTRACT

In accordance with the present invention, a method of electro-photographically manufacturing a luminescent screen assembly for a color CRT 10 on an interior surface of a faceplate panel 12 is described. A volatilizable, organic conductive (OC) layer 32 is provided on the interior surface of the panel and a volatilizable, organic photoconductive (OPC) layer 34 overlies the OC layer. The method includes the steps of: establishing a substantially uniform electrostatic charge on the OPC layer; exposing selected areas of the OPC layer to visible light to affect the charge thereon; developing the selected areas of the OPC layer with a triboelectrically charged dry-powdered, screen structure materials; fixing the screen structure materials to the underlying OPC layer with a suitable fixative; filming the screen structure materials; aluminizing the screen; and baking the aluminized screen. The present method is an improvement over prior methods because the relative humidity (RH) during the charging step is maintained above a humidity level below which the performance of the OC layer is negatively impacted by a reduction in its ion transfer mobility which makes it difficult to apply a usable corona charge to the overlying OPC layer, and below a humidity level above which the OC layer swells causing cracking in the OPC layer. Additionally, the RH during the development step is maintained below a humidity above which the screen structure materials can absorb water and macro-agglomerate, thereby changing the charge-to-mass ration of the screen structure materials to a value which adversely affects the deposition thereof.

6 Claims, 3 Drawing Sheets

Fig. 1
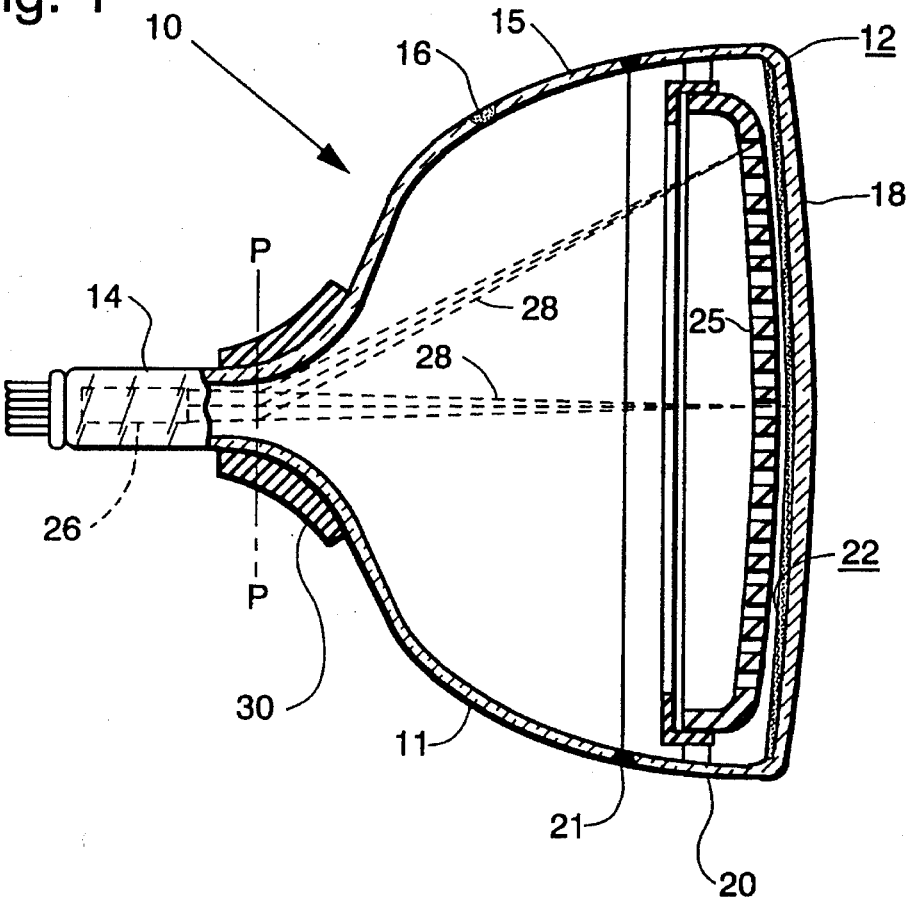
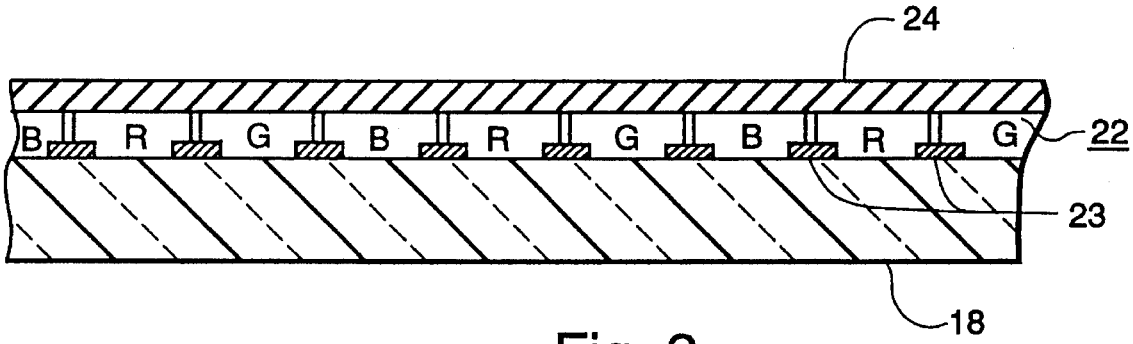
Fig. 2

METHOD OF MANUFACTURING A LUMINESCENT SCREEN FOR A CRT UNDER AMBIENT CONTROLS

The present invention relates to a method of electrophotographically manufacturing a luminescent screen assembly for a cathode-ray tube (CRT), and more particularly to a method of manufacturing a screen assembly while controlling the temperature and humidity during certain critical steps in the manufacturing process.

BACKGROUND OF THE INVENTION

U.S. Pat. No. 4,921,767, issued to Datta et al., on May 1, 1990, describes the basic method of manufacturing a luminescent screen for a color CRT by the electrophotographic screening (EPS) method, using dry-powdered, triboelectrically charged screen structure materials that are serially deposited onto a suitable photoreceptor disposed on an interior surface of a faceplate panel. The photoreceptor comprises, preferably, an organic conductive (OC) layer and an overlying organic photoconductive (OPC) layer. In the above-referenced patent, the OPC layer is a volatilizable organic polymeric material such as polyvinyl carbazol, n-ethyl carbazole, n-vinyl carbazole or tetraphenyl butatriene (TPBT) dissolved in a suitable binder, such as polymethyl methacrylate or polypropylene carbonate. A drawback of these OPC materials is that they tend to develop cracks when held for a period of about 48 hours, at a relative humidity of about 75%. Forty eight hours represents a typical weekend during which the manufacturing operation may be shut down. Faceplate panels, having such a OPC layer deposited on a Friday and held in an uncontrolled environment over the weekend, may be unusable the following Monday.

U.S. Pat. No. 5,135,826, issued on Aug. 4, 1992 to Ritt et al., describes a method of manufacturing a screen assembly by the EPS process wherein a suitable quantity of a dialkyl phthalate plasticizer is added to the solution which is used to form the OPC layer. The plasticizer permits the panels, coated with a photoreceptor, to be held over a weekend without any special humidity control. Panels coated with a photoreceptor having the above-mentioned plasticizer in the OPC layer display acceptable electrical characteristics when charged for 30 seconds in an ambient atmosphere of 21° C. and 68% RH. However, panels made using the cabazole-containing materials exhibit a tendency to develop cracks during filming, and a long time is required to bakeout the volatilizable constituents of the OPC layer during screen bake. Panels made using TPBT exhibit a tendency of the OPC layer to crystallize, and the layer has no appreciable sensitivity in the wavelength of current interest, i.e., 400–500 nm. The crystallization is objectionable because electrical breakdown occurs at the crystal sites, and produces phosphor and/or matrix defects at these sites.

An improved OC layer includes certain quarternary ammonium polyelectrolytes recited in U.S. Pat. No. 5,370,952 issued on Dec. 6, 1994 to Datta et al. Preferably the OPC layer is formed from a solution containing polystyrene; an electron donor material, such as 1,4-di(2,4-methyl phenyl)-1,4 diphenylbutatriene (hereinafter 2,4-DMPBT); an electron acceptor material, such as 2,4,7-trinitro-9-fluorenone (herinafter TNF) and 2-ethylanthroquinone (hereinafter 2-EAQ); and a solvent, such as toluene or xylene. The preferred OPC layer possesses fewer of the shortcomings of the prior materials. However, it has been determined that even with the improved OPC layer, certain steps in the EPS process can be further optimized by controlling at least the relative humidity as well as the temperature, during these process steps.

SUMMARY OF THE INVENTION

In accordance with the present invention, a method of electrophotographically manufacturing a luminescent screen assembly for a color CRT on an interior surface of a faceplate panel is described. A volatilizable, organic conductive (OC) layer is provided on the interior surface of the panel and a volatilizable, organic photoconductive (OPC) layer overlies the OC layer. The method includes the steps of establishing a substantially uniform electrostatic charge on the OPC layer; exposing selected areas of the OPC layer to visible light to affect the charge thereon; developing the selected are of the OPC layer with triboelectrically charged, dry-powdered, screen structure materials; fixing the screen structure materials to the underlying OPC layer with a suitable fixative; filming the screen structure materials; and aluminizing the screen. The present method is an improvement over prior methods because the relative humidity (RH) during the charging step is maintained above a humidity level below which the performance of the OC layer is negatively impacted by a reduction in the ion transfer mobility, and below a humidity level above which the OC layer swells causing cracking in the OPC layer. Additionally, the RH during the development step is maintained below a humidity above which said screen structure materials can absorb water and macro-agglomerate, thereby changing the charge-to-mass ration of the screen structure materials to a value which adversely affects the deposition thereof.

BRIEF DESCRIPTION OF THE DRAWINGS

The invention will now be describe in greater detail, with relation to the accompanying drawings, in which:

FIG. 1 is a plan view, partially in axial section, of a color CRT made according to the present invention;

FIG. 2 is a section of a faceplate panel of the CRT of FIG. 1 showing a screen assembly.

DETAILED DESCRIPTION OF THE PREFERRED EMBODIMENTS

Figure 3:
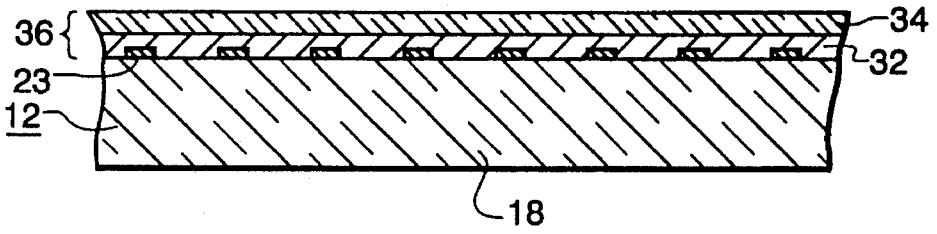
FIGS. 3–9 show selected steps in the manufacturing operation.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A luminescent three color phosphor screen 22 is carried on the inner surface of the faceplate 18. The screen 22, shown in FIG. 2, is a line screen which includes a multiplicity of screen elements comprised of red-emitting, green-emitting and blue-emitting phosphor stripes R,G, and B, respectively, arranged in color groups or picture elements of three stripes or triads, in a cyclic order. The stripes extend in a direction which is generally normal to the plane in which the electron beams are generated. In the normal viewing position of the embodiment, the phosphor stripes extend in the vertical direction. Portions of the phosphor stripes overlap a relatively thin, light absorptive matrix 23, preferably of the type formed by the "wet"

process, described in U.S. Pat. No. 3,558,310, issued to Mayaud on Jan. 26, 1971, or of the type formed by the EPS process in either a single step, as described in the above-cited U.S. Pat. No. 4,921,767, or by the "two step" process described in U.S. Pat. No. 5,229,234, issued to Riddle et al., on Jul. 20, 1993. The "two step" matrix deposition process increases the opacity of the resultant matrix over that of the single step process, so that it has an opacity equivalent to that of the matrix formed by the "wet" process. Alternatively, the matrix can be formed by the EPS process after the screen elements are deposited, as described in U.S. Pat. No. 5,240,798, issued to Ehemann, Jr., on Aug. 31, 1993. A dot screen also may be formed by the novel process. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or showdown mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

The screen is manufactured by an electrophotographic screening (EPS) process that is shown schematically in FIGS. 3–9. Initially, the panel 12 is cleaned by washing it with a caustic solution, rinsing it in water, etching it with buffered hydrofluoric acid and rinsing it again with water, as is known in the art. The interior surface of the viewing faceplate 18 is then provided with the light absorbing matrix 23, preferably, using the conventional wet matrix process described in U.S. Pat. No. 3,558,310. For a panel 12 having a diagonal dimension of 51 cm (20 inches), the window openings formed in the matrix have a width of about 0.13 to 0.18 mm, and the matrix lines have a width of about 0.1 to 0.15 mm. The interior surface of the faceplate 18, having the matrix 23 thereon, is then coated with a suitable volatilizable, organic conductive material to form an organic conductive (OC) layer 32, which provides an electrode for an overlying volatilizable, organic photoconductive (OPC) layer 34. The OC layer 32 and the OPC layer 34 are shown in FIG. 3 and, in combination, comprise a photoreceptor 36.

Figure 4:
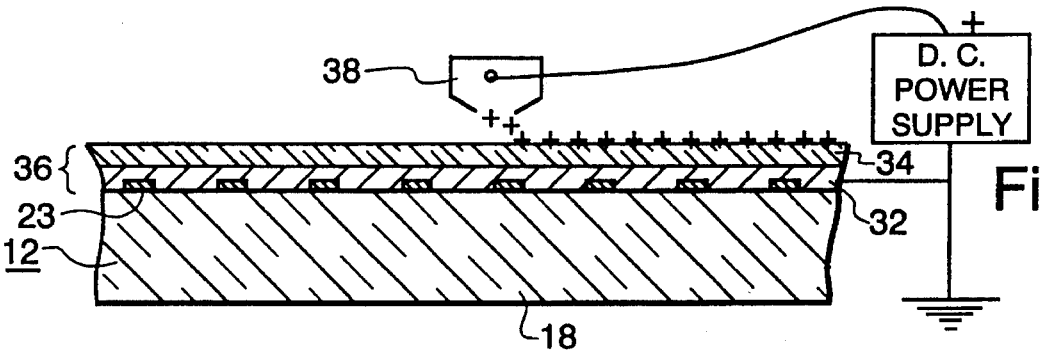

Suitable materials for the OC layer 32 include certain quaternary ammonium polyelectrolytes recited in the above-cited U.S. Pat. No. 5,370,952, issued to Datta et al. on Dec. 6, 1994. Preferably, the OPC layer 34 is formed by coating a solution containing polystyrene; an electron donor material, such as 1,4-di(2,4-methyl phenyl)-1,4 diphenylbutatriene (2,4-DMPBT); electron acceptor materials, such as 2,4,7-trinitro-9-fluorenone (TNF) and 2-ethylanthroquinone (2-EAQ); and a solvent, such as toluene or xylene. A surfactant, such as silicone U-7602 and a plasticizer, such as dioctyl phthalate (hereinafter DOP) also may be added to the solution. The surfactant U-7602 is available from Union Carbide, Danbury Conn. As shown in FIG. 4, the OPC layer 34 is uniformly electrostatically charged using a corona discharge device 38, described in U.S. Pat. No. 5,083,959, issued on Jan. 28, 1992 to Datta et al., which charges the OPC layer 34 to a voltage within the range of approximately +200 to +700 volts. It has been determined that relative humidity (RH) levels in the charger must be maintained within the range of approximately 40–65%, and preferably within the range of approximately 45–55% RH. Relative humidity levels below 45% negatively impact the performance of the OC layer 32 by reducing the ion transfer mobility of the OC layer, making it difficult to apply a usable corona charge to the overlying OPC layer 34. Humidity levels above 55% cause the OC layer 32 to swell, which can lead to unpredictable cracking of the OPC layer 34. Cracking can cause the two layers to separate, resulting in the rupture of the OPC layer 34. Delayed cracking of the OPC layer has been observed to occur due to the slow release of moisture from the OC layer 32, after being exposed to humidity levels in excess of 55%. It also is necessary to control the temperature of the charger within the range of approximately 20–35° C., and preferably with the range of 22–28° C. The relative humidity and temperature for the EPS process are controlled by performing the screening operations in a room having a controlled environment which is maintained at an RH of 45±3%, and at a temperature of 22°±2° C.

Figure 5:
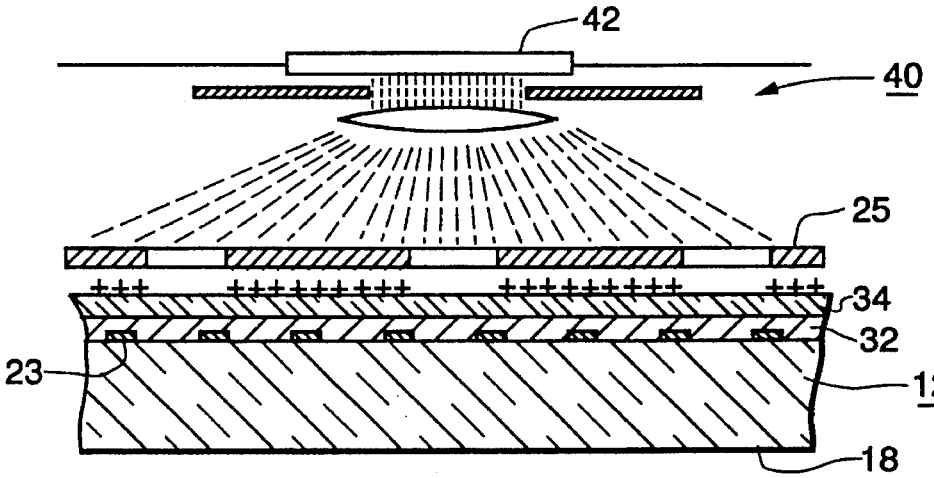
Figure 6:
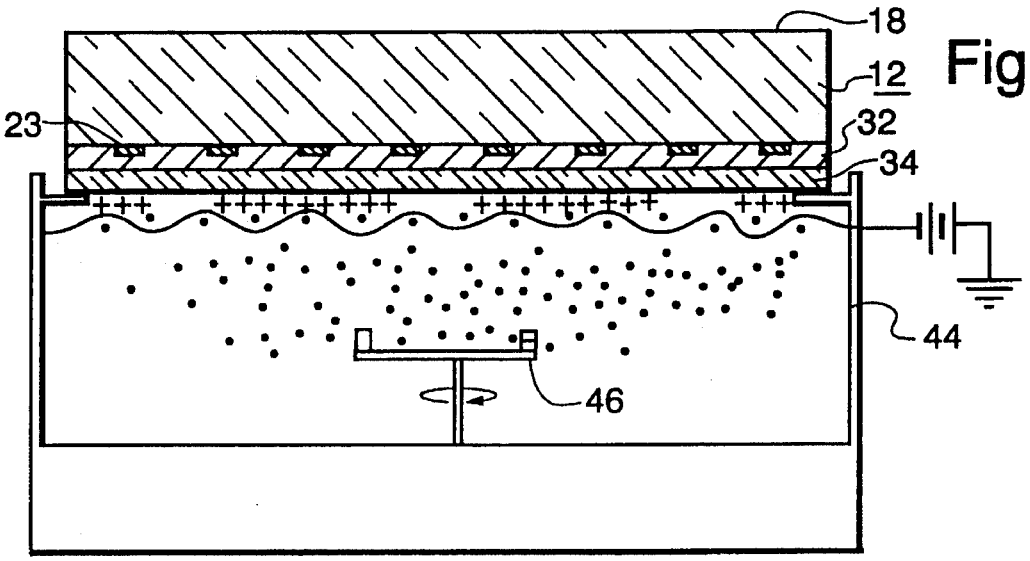
Figure 7:
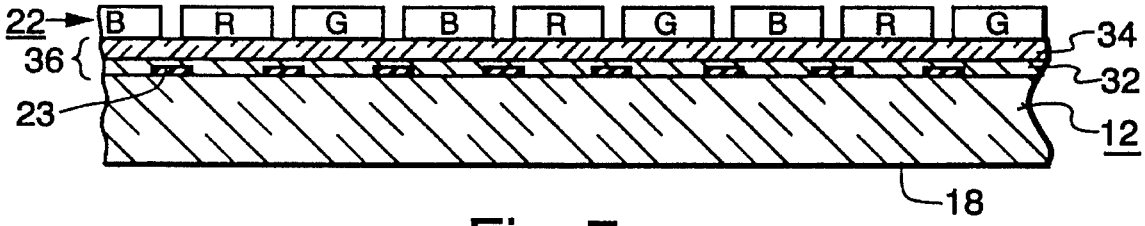

The shadow mask 25 is then inserted into the panel 12, which is placed onto a lighthouse 40, shown schematically in FIG. 5, and the positively charged OPC layer 34 is exposed, through the shown mask 25, to light from a xenon flash lamp 42, or other light source of sufficient intensity, such as a mercury arc, disposed within the lighthouse. The light which passes through the apertures in the shadow mask 25, at an angle identical to that of one of the electron beams from the electron gun of the tube, discharges the illuminated areas on the OPC layer 34 on which it is incident. The shadow mask is removed from the panel 12 and the panel is placed onto a first phosphor developer 44, such as that shown in FIG. 6. The developer includes a phosphor reservoir (not shown) which is maintained at a relative humidity of 55%, or less, and preferably about 50%, or less. At an RH greater that 50%, the phosphors can absorb water, thereby reducing their charge-to-mass ratio to a level which adversely affects their deposition. Additionally, RH in excess of 50% causes clumping, or macro-agglomeration, of the phosphor particles within the reservoir and results in agglomerated particles having a nominal diameter as large as 250 μ, whereas the acceptable particle size is about 7.0 μ. The particles from the reservoir are carried through the triboelectric gun 46 by air, which is controlled to have a dew point of −40° C., or less. At dew points above −40° C., the individual phosphor particles also will micro-agglomerate to form phosphor particles having a nominal diameter of about 15–50 μ, so that the charge imparted by the triboelectric action is dissipated, resulting in a non-optimized charge-to-mass distribution of the particles. The low dew point of the air further reduces the humidity in the developer 44 by about 3% during the phosphor deposition. The first color-emitting phosphor material is triboelectrically charged positive within the developer 44 by a triboelectric gun 46 and directed toward the OPC layer 34. The positively charged first color-emitting phosphor material is repelled by the positively charged areas on the OPC layer 34 and deposited onto the discharged areas thereof by the process known in the art as "reversal" development. In reversal development, triboelectrically charged particles of screen structure material are repelled by similarly charged areas of the OPC layer 34 and deposited onto the discharged areas thereof. The size of each of the lines of the first color-emitting phosphor is slightly larger than the size of the openings in the light-absorbing matrix to provide complete coverage of each opening, and a slight overlap of the light-absorbing matrix material surrounding the openings. The panel 12 is then recharged using the above-described corona discharge apparatus. A positive voltage is established on the OPC layer 34 and on the first color-emitting phosphor material deposited thereon. The light exposure and phosphor development steps are repeated for each of the two remaining color-emitting phosphors, with the same RH and temperature control utilized for the deposition of the first color-emitting phosphor. The size of each of the lines of the color-emitting phosphors on the OPC layer 34 also is larger than the size of the matrix openings, to ensure that no gaps occur and that a slight overlap of the light-absorbing matrix material surrounding the openings is provided. The resultant screen 22 is shown in FIG. 7.

Figure 8:
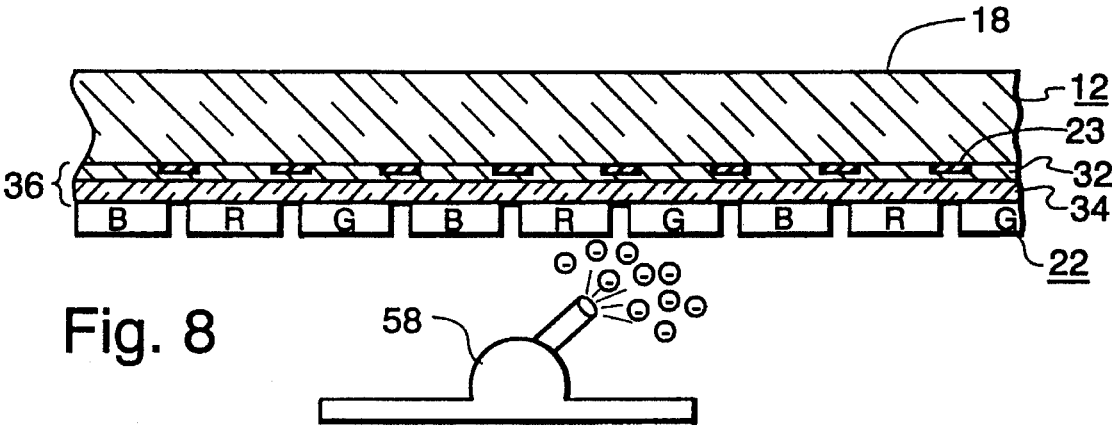

The three light-emitting phosphors of the screen 22 are fixed to the above-described OPC layer 34 by contacting the phosphors with a suitable fixative that is electrostatically charged by an electrostatic spray gun 58, shown in FIG. 8. Suitable fixatives include such solvents as acetone, amyl acetate; butyl acetate; methyl isobutyl ketone (MIBK); methyl ethyl ketone (MEK); toluene; and xylene; and polymeric solutions, such as an acrylic resin dissolved in MIBK; and poly-alphamethyl styrene (AMS) dissolved in MIBK.

Any one of the above-mentioned solvents may be used to fix the phosphors to the underlying OPC layer 34. The preferred electrostatic spray gun is an AEROBELL™ model, available from ITW Ransburg, Toledo, Ohio. The electrostatic gun provides negatively charged droplets of uniform size which wet the phosphors and the underlying OPC layer 34, without moving the phosphors. As shown in FIG. 8, the panel 12 is oriented with the OPC layer 34 and the phosphors directed downwardly toward the electrostatic gun. The downward orientation of the panel prevents any large droplets, formed on the gun, from dropping onto the screen 22 and moving the phosphors. The polystyrene used in the OPC layer 34 is completely soluble in amyl acetate, butyl acetate, MIBK, toluene and xylene, and partially soluble in acetone. However, MIBK is preferred because it dissolves the polystyrene of the OPC layer 34 more slowly than the other solvents.

Figure 9:
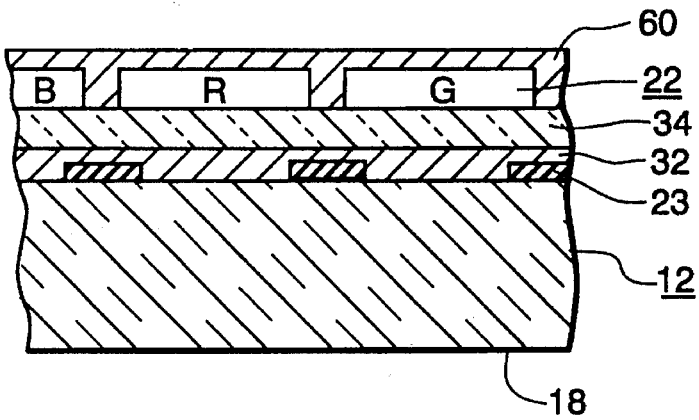

The screen 22 is then filmed to provide a layer 60, shown in FIG. 9, which forms a smooth surface over the screen 22 onto which the aluminum layer 24 is deposited. The filming may be a conventional emulsion filming, or a dry film as described in the above-cited U.S. Pat. No. 5,028,501, issued to Ritt et al., on Jul. 2, 1991, or the filming may comprise an electrostatically deposited polymeric solution. One preferred material is an acrylic resin dissolved in MIBK. Good results have been obtained using a resin, available from Pierce and Stevens, Buffalo, N.Y. That acrylic resin comprises 90 wt. % of polymethyl methacrylate, 9 wt. % of isobutyl methacrylate, and the balance being the plasticizer DOP, and nitrocellulose. The resin comprises about 3 to 10 wt. % of the filming solution. After filming, the screen assembly is baked at a temperature of about 425° C., for about 30 minutes, to drive off the volatilizable constituents of the screen assembly.

What is claimed is:

1. In a method of manufacturing a luminescent screen assembly on an interior surface of a faceplate panel of a color CRT by the electrophotographic screening (EPS) process including the steps of:

a) providing an organic conductor (OC) layer on said interior surface of said panel;

b) forming an overlying organic photoconductor (OPC) layer on said OC layer;

c) electrostatically charging said OPC layer, d) exposing selected areas of said OPC layer to light to form a charge image thereon;

e) developing said charged image on said OPC layer by applying a first triboelectrically charged screen structure material thereto;

f) repeating steps c) through e) for at least two additional triboelectrically charged screen structure materials to form a luminescent color screen;

g) fixing said screen structure material to said OPC layer;

h) filming said screen;

i) aluminizing said screen; and j) baking said aluminized screen to remove volatilizable constituents therefrom to form said luminescent screen assembly, the improvement wherein:

the relative humidity during step c) is maintained above the humidity below which the performance of the OC layer is negatively impacted by reduced ion transfer mobility of the OC layer, and below a humidity above which cracking of said OPC layer may occur; and the relative humidity during step e) is maintained below a humidity above which said screen structure materials can absorb water and macro-agglomerate, thereby changing the charge-to-mass ratio of said materials to a value which adversely affects the deposition thereof.

2. The method as described in claim 1, wherein the relative humidity during step c) is maintained with the approximate range of 40–65%, and the temperature is maintained within the approximate range of 20–35° C.

3. The method as described in claim 1, wherein the relative humidity during step c) is maintained within the approximate range of 45–55%, and the temperature is maintained within the approximate range of 22–28° C.

4. The method as described in claim 1, wherein the relative humidity during step e) is maintained at 55%, or less.

5. The method as described in claim 1, wherein the relative humidity during step e) is maintained at 50%, or less.

6. The method as described in claim 1, wherein the dew point for applying said screen structure materials in step e) is approximately –40° C., or less.

* * * * *